US007347639B2

(12) United States Patent
Dieudonat et al.

(10) Patent No.: US 7,347,639 B2
(45) Date of Patent: Mar. 25, 2008

(54) APPLICATOR DISPENSER FOR A POWDER PRODUCT

(75) Inventors: Fabrice Dieudonat, Fosses (FR); Anne-Sophie Vintimiglia, Paris (FR)

(73) Assignee: Techpack International, Chevilly-Larue (FR)

( * ) Notice: Subject to any disclaimer, the term of this patent is extended or adjusted under 35 U.S.C. 154(b) by 84 days.

(21) Appl. No.: 11/288,122

(22) Filed: Nov. 29, 2005

(65) Prior Publication Data

US 2006/0127164 A1 Jun. 15, 2006

(30) Foreign Application Priority Data

Dec. 14, 2004 (FR) ..... 04 13267

(51) Int. Cl.
*A45D 33/02* (2006.01)

(52) U.S. Cl. ..... 401/200; 401/123; 401/207

(58) Field of Classification Search ..... 401/55, 401/82, 118, 123, 200, 201, 202, 207; 132/293, 132/294, 298

See application file for complete search history.

(56) References Cited

U.S. PATENT DOCUMENTS

| | | | | |
|---|---|---|---|---|
| 4,810,122 | A * | 3/1989 | Cole | 401/122 |
| 5,743,279 | A * | 4/1998 | Gueret | 401/122 |
| 2002/0003983 | A1 | 1/2002 | Gueret | |
| 2002/0048481 | A1 | 4/2002 | Gueret | |

FOREIGN PATENT DOCUMENTS

GB 2 296 654 A 7/1996

* cited by examiner

*Primary Examiner*—Tuan Nguyen
(74) *Attorney, Agent, or Firm*—Young & Thompson

(57) ABSTRACT

An applicator dispenser (1) includes a) a receptacle (2) forming a reservoir (27) having a sidewall (20), an upper dome (22) with a plurality of orifices (24, b) a cap (3) including a head (30) and a side skirt (31), and c) an application element (4) for the powder housed between the head (30) and the element dome (22). The application element (4) is fixed to the cap (3) to form an applicator (9). It has an H/D shape factor equal to at least 1.5, so that the applicator dispenser (1, 1') is longitudinal and has an axial direction (10), where H is the height and D denotes its maximum transverse dimension.

32 Claims, 9 Drawing Sheets

APPLICATOR DISPENSER FOR A POWDER PRODUCT

DOMAIN OF THE INVENTION

The invention relates to the domain of applicator dispensers for a powder product, typically a powder cosmetic product intended for face makeup.

STATE OF THE ART

A large number of powder product applicator dispensers are already known. In many cases, these applicator dispensers comprise a powder reservoir above which there is an applicator, for example as in patents U.S. Pat. No. 4,626,119, EP 0 364 667, FR 2 802 069, FR 2 823 081.

Furthermore, a large number of powder product dispensers are also known including an application means in the form of a powder puff in the case in which the powder is in the form of an agglomerated block, these dispensers then being classical makeup compacts.

Finally, patent FR 2 848 392 issued in the name of the applicant also describes a-non agglomerated powder dispenser comprising an application means with a role equivalent to a powder puff in a traditional compact.

PROBLEMS THAT ARISE

Firstly, many applicator dispensers according to the state of the art are relatively large, and are designed to be placed on a bathroom shelve. Therefore, there is a need for "mobile" applicator dispensers with a relatively modest size so that they can for example be carried in a handbag.

Furthermore, it is important that these applicator dispensers should be ergonomic in use, and that they prevent the fingers from getting dirty.

Furthermore, there is a need for dispensers that are easy to manipulate while applying the said powder and are also slender, for example something like the shape of a lipstick tube.

Furthermore, a ongoing renewal of products and packaging is necessary in the domain of cosmetic products.

Finally, considering changes to powder formulas, in some cases it may be useful if these applicator dispensers are relatively leak tight so as to prevent any evaporation of a volatile constituent of the said powder.

DESCRIPTION OF THE INVENTION

According to the invention, the applicator dispenser of a powder product, and typically a cosmetic product forming a powder, comprises a) a receptacle forming a reservoir that will contain the said powder product, the said receptacle comprising a sidewall, an upper dome with perforations something like a netting with at least one orifice or a plurality of orifices through which the said powder can pass so that it can be used, and typically a bottom, b) a cap or cover comprising a head and a side skirt cooperating with the said receptacle when the said applicator dispenser is closed so as to close the said receptacle, and c) an application means for the said powder housed between the said head and the said dome.

It is characterised in that:

1) the said application means is fixed to the said cap due to an attachment means to form an applicator, such that the said cap acts like a manual means of gripping the said application means without any risk of getting the fingers dirty, 2) it has an H/D shape factor equal to at least 1.5, so that the applicator dispenser is longitudinal and has an axial direction, where H is the height of the said applicator dispenser along the said axial direction, and D denotes its maximum transverse dimension or its diameter in the case of an applicator dispenser with a constant circular cross section over all of the said height H.

The applicator dispensers according to the invention solve the problems that arise.

These applicator dispensers are "mobile" applicator dispensers with a relatively modest size and that can be carried, for example in a handbag.

Furthermore, the said cap used as a means of manually gripping the said application means, therefore there is no risk of getting the fingers dirty during application of the said product.

It is also easier to manipulate a relatively lightweight cap than the body of the dispenser containing the said product, that is necessarily heavier and larger.

Furthermore, considering its slender shape, the shape of the applicator dispenser according to the invention is similar to the shape of a lipstick tube.

Finally, the applicator dispenser according to the invention changes the shape of powder dispensers, which is commercially very advantageous.

DESCRIPTION OF THE FIGURES

All Figures relate to the same embodiment of longitudinal applicator dispenser (1, 1') according to the invention.

FIG. 3*a* shows a perspective view.

FIG. 3*b* shows a side view.

FIG. 3*c* is a top view.

FIG. 3*d* is an axial section.

FIG. 3*e* is an enlarged view of the part surrounded by a rectangle marked by "e" in FIG. 3*d*.

FIGS. 4*a* and 4*b* are perspective views, FIG. 4*a* partially showing the bottom of the inner part (6), FIG. 4*b* partially showing the top of the inner part (6).

FIG. 4*c* is a top view.

FIG. 4*d* is a side view.

FIG. 4*e* is an axial section.

FIG. 5*a* is a side view.

FIG. 5*b* is an axial section.

FIG. 5*c* is an enlarged view of the part surrounded by a rectangle marked by "c" in FIG. 5*b*.

FIG. 6*a* shows the said outer body (5) and the said inner part (6) before axial click fitting (represented by a vertical arrow).

FIG. 6*b* shows the receptacle (2) obtained after click fitting and forming the cooperation means (28) of the outer body (5) and the inner part (6).

In FIG. 7*a*, the longitudinal block (40) is a "T" shape and the cap (3) does not include any axial projection (33).

In FIG. 7*b*, the axial projection (33) forms a plurality of axial projections (35), the ends of which are provided with hooks (350).

In FIG. 7*c*, the axial projection (33) forms a central projection (36) provided with a hook (360).

FIG. 7*d* corresponds to the applicator in FIG. 1*e* and in FIG. 1*b*.

In FIGS. 7*e* and 7*f*, the said block (40) is fixed to an insert (42), itself fixed to the cap (3).

In FIG. 7*e*, the insert (42) only includes a base, while it comprises a tubular axial part (420) in the case in FIG. 7*f*.

In FIG. 8*a*, the receptacle (2) is formed by a receptacle (2') and a lower closer (7).

In FIG. 8*b*, the receptacle (2) comprises an outer body (5), an inner part (6) and a lower closer (7).

In this embodiment, the receptacle (2) is a tube (29) that is shown in the upside down position (before filling in FIG. 9*a* and after filling in FIG. 9*b*), the bottom of the tube having been closed off by heat sealing.

Figure 9A:
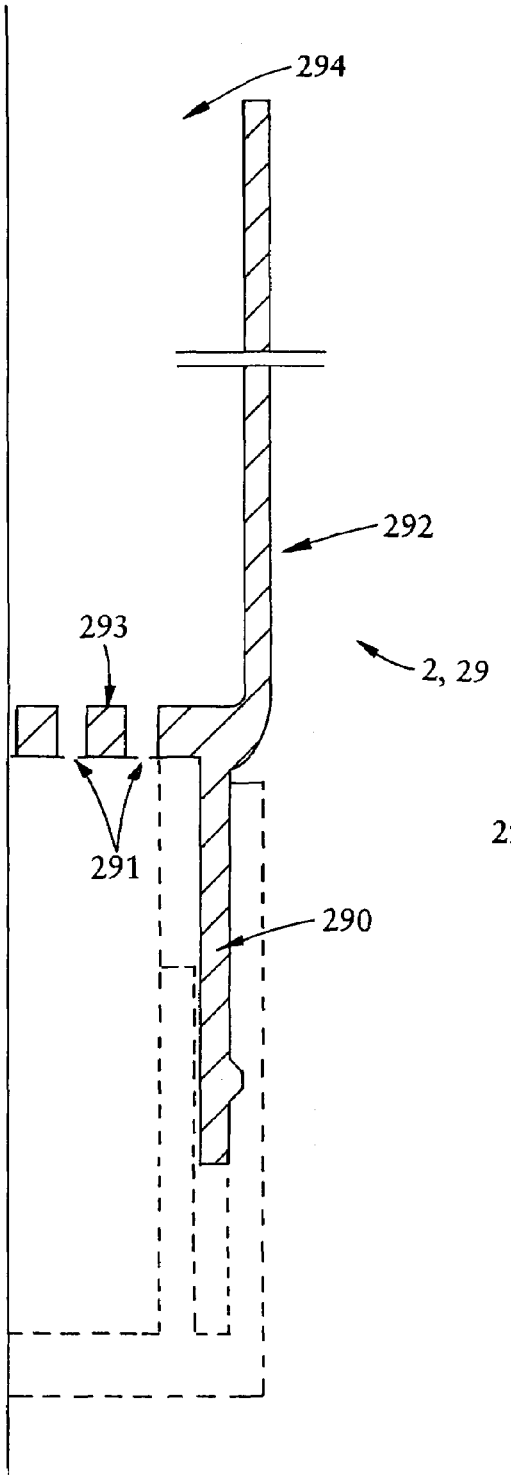
FIGS. 9*a* and 9*b* are partial axial sections of dispensers (1, 1') illustrating another embodiment of the receptacle (2).
Figure 9B:
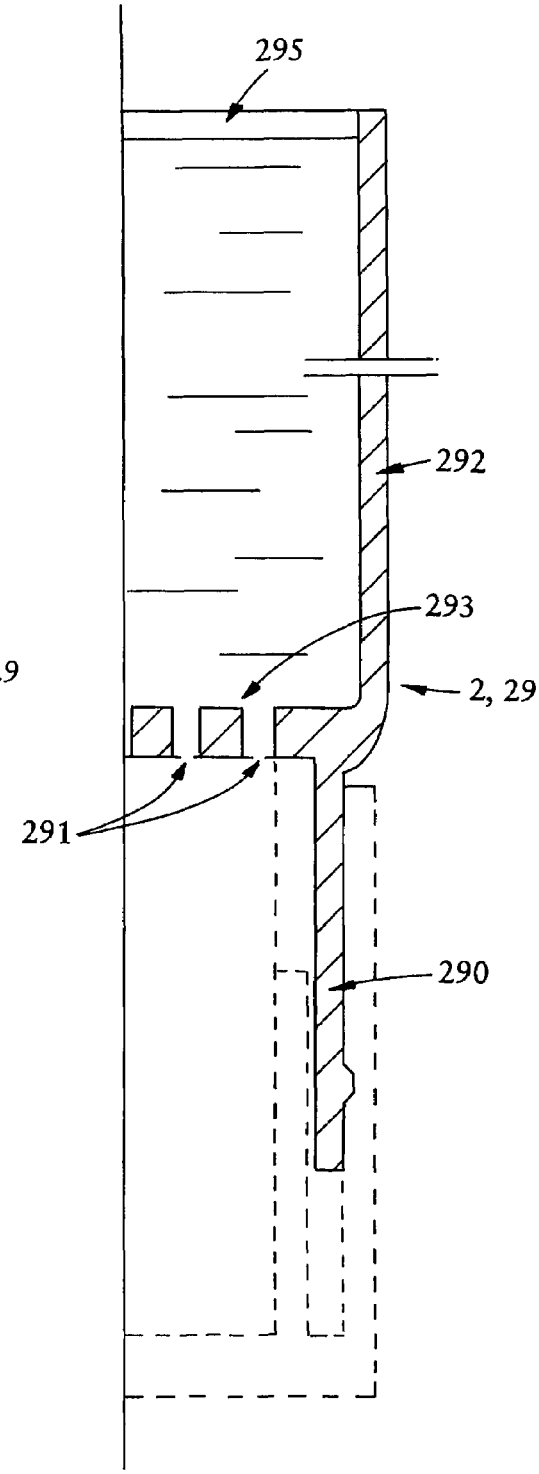

FIGS. 9*a* and 9*b* show the cap (3) and the application means (4) in dashed lines.

DETAILED DESCRIPTION OF THE INVENTION

According to the invention the said H/D shape factor may be equal to at least 2, and preferably equal to at least 3.

Thus for example, the dispenser illustrated in FIGS. 1*a* to 1*e* has a height H of 67 mm and a maximum diameter D of 18 mm such that its H/D shape factor is equal to 3.7.

As illustrated in FIGS. 1*a* to 4*e*, the said receptacle (2) may comprise an outer body (5) comprising a bottom (50) and an outer wall (51), and an inner part (6) comprising the said dome (22, 60) and an inner wall (61) fixing the said inner part (6) to the said outer body (5) typically by axial click fitting. The said inner wall (61) of the said inner part (6) may include a lower part (610) forming a lower skirt fixing the said inner part (6) to the said outer body (5) by axial click fitting.

Figure 1F:
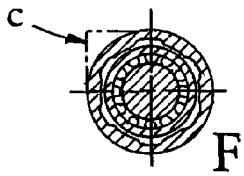
FIG. 1*f* shows an axial sectional view along the axial plain B-B in FIG. 1*e*.
Figure 1E:
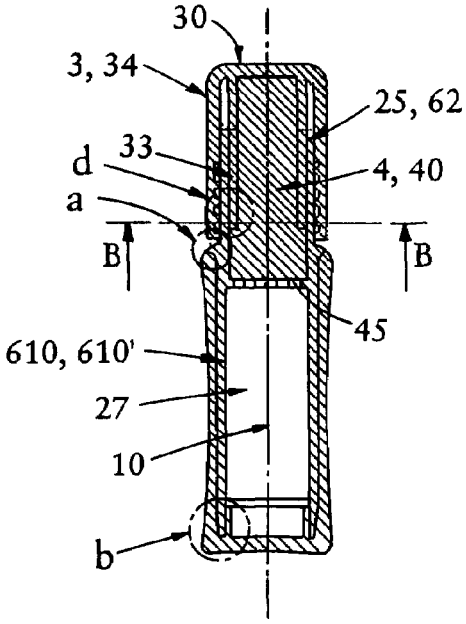
FIG. 1*e* shows an axial sectional view along the axial plane A-A in FIG. 1*d*.
Figure 4E:
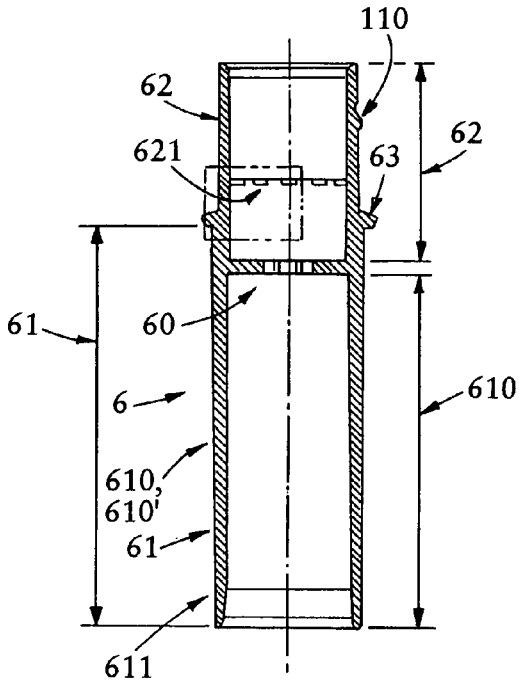
FIGS. 4*a* to 4*e* relate to the inner part (6) of the said receptacle (2).
Figure 4D:
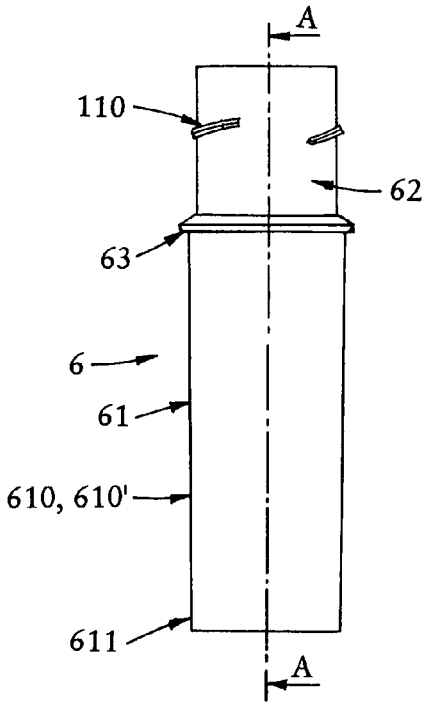

As illustrated in FIGS. 1*e*, 4*e* and 4*d*, the said lower skirt may a long skirt (610').

Figure 2D:
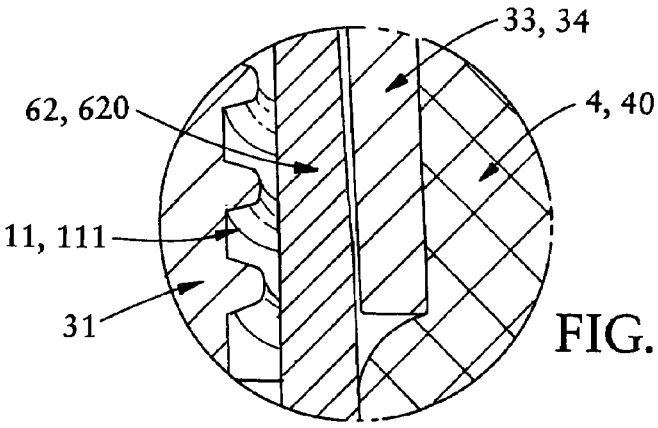
FIG. 2*d* shows an enlarged view of the part surrounded by a circle marked "d" in FIG. 1*e*.
Figure 2C:
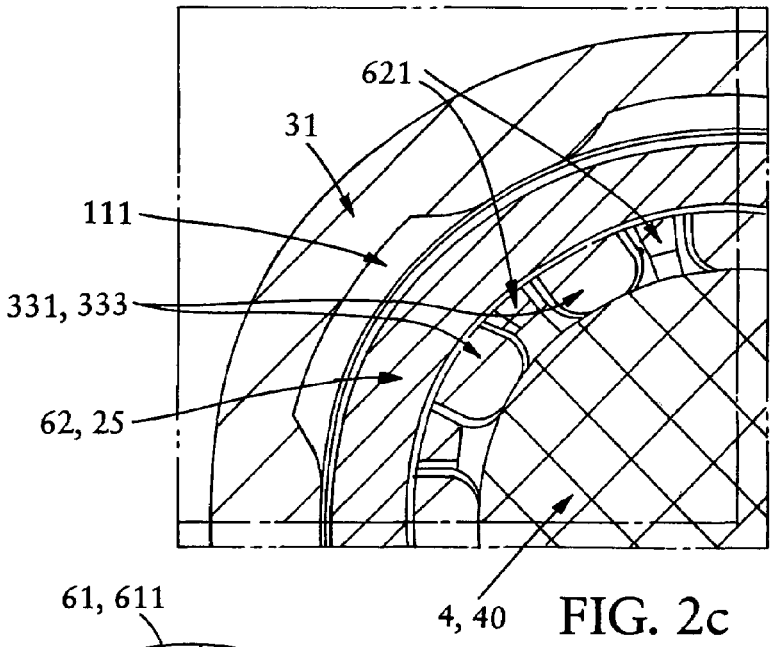
FIG. 2*c* shows an enlarged view of the part surrounded by a rectangle marked "c" in FIG. 1*f*.
Figure 2B:
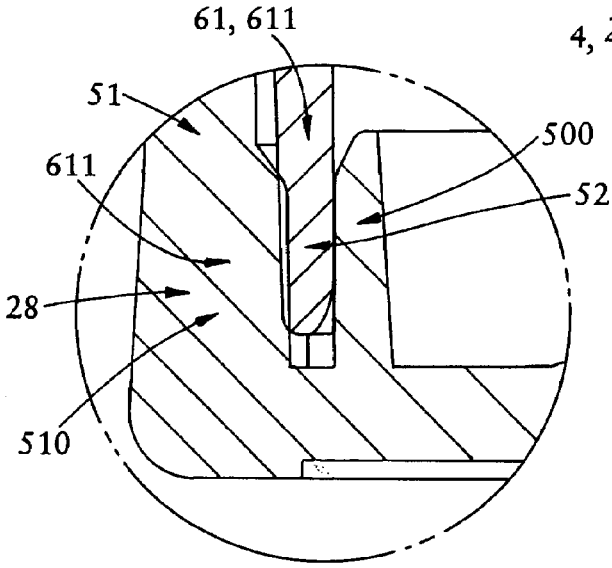
FIG. 2*b* shows an enlarged view of the part surrounded by a circle marked "b" in FIG. 1*e*.

As illustrated in FIG. 2*b*, the said long skirt (610') may cooperate at its lower end (611) with an inner bottom closer (500) fixed to the said bottom (50), such that the said lower end (611) is force fitted into an annular cavity (52) formed between the said inner bottom closer (500) and the said outer wall (51) at its lower end (510).

The said lower end (611) may typically be force fitted into the said annular cavity (52) so as to create a leak tight and mechanically fixed connection between the said outer body (5) and the said inner part (6).

Figure 6A:
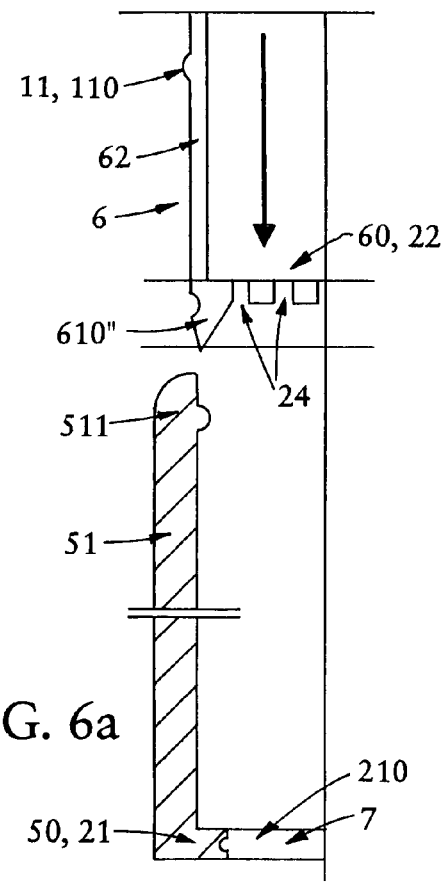
FIGS. 6*a* and 6*b* are partial axial sections related to a method of arranging the outer body (5) and the said inner part (6).
Figure 6B:
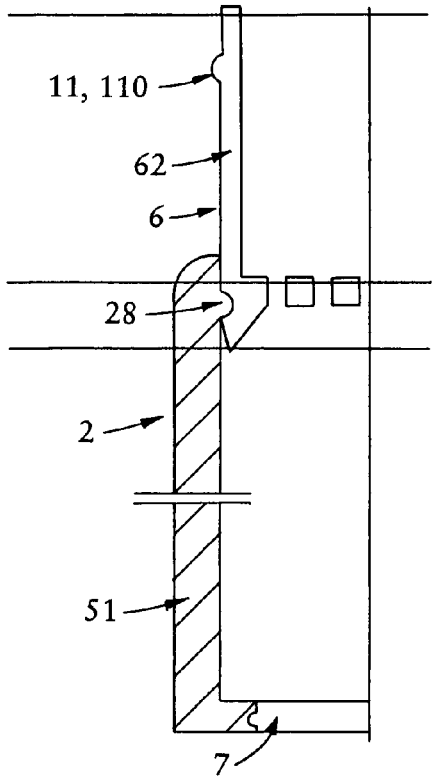

However as illustrated in FIGS. 6*a* and 6*b*, the said lower skirt may be a short skirt (610") with a sufficient axial height to achieve the said axial click fitting.

As illustrated in FIGS. 6*a* and 6*b*, the said bottom (21) of the said receptacle (2) or the said bottom (50) of the said outer body (5) may include or form a lower orifice (210) blocked off by a lower closer (7), the said lower closer (7) being fixed to the said receptacle (2) or to the said outer body (5), typically by axial click fitting, after the said applicator dispenser (1, 1') has been filled through the bottom.

According to the invention and as diagrammatically illustrated in FIGS. 7*a* to 7*f*, the said application means (4) may be fixed to the head (30) of the said cap (3) to form the said applicator (9), and the said application means (4) may have a section in a transverse plane chosen so as to have an annular space (32) between the said side skirt (31) of the said cap (3) and the said application means (4).

Typically, the said application means (4) may form a longitudinal application block (40) with height $H_A$ varying from 10 mm to 60 mm and preferably from 20 mm to 50 mm.

Figure 7A:
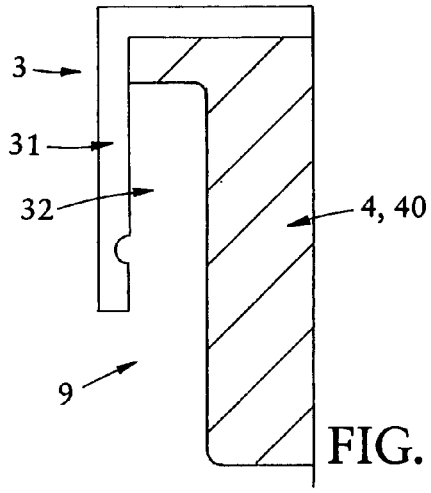
FIGS. 7*a* to 7*f* are partial axial half-sections of applicators (9).
Figure 7C:
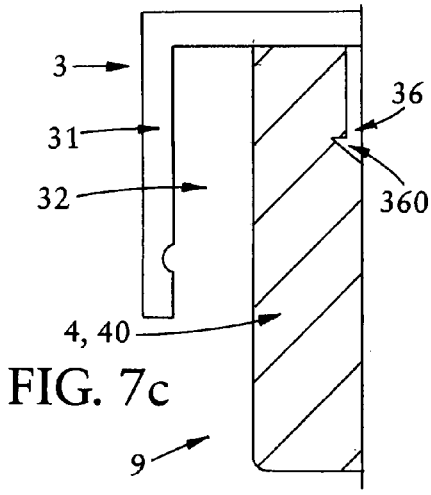
Figure 7B:
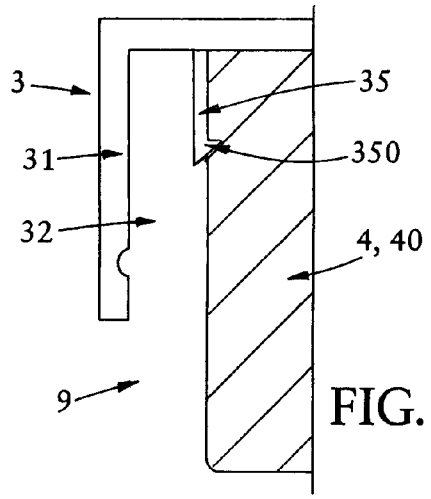
Figure 7D:
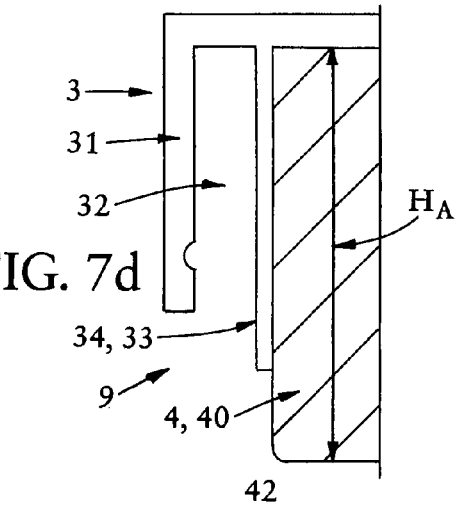

According to one embodiment of the invention illustrated in FIGS. 7*b*, 7*c* and 7*d*, the said cap (3) may include an axial projection (33) fixed at its upper end to the said head (30) of the said cap (3) or an insert (8) assembled to the said cap (3), the said axial projection (33) forming the said attachment means.

Figure 5B:
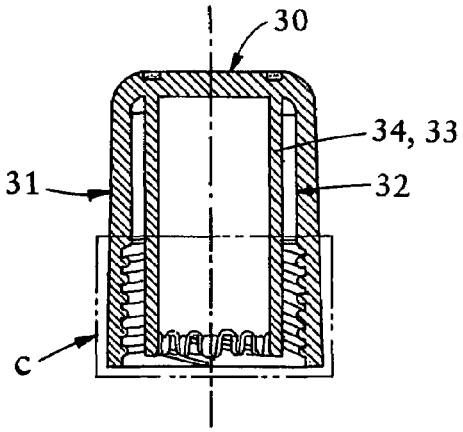
FIGS. 5*a* to 5*c* relate to the cap (3).

As illustrated in FIGS. 1*e*, 5*b* and 7*d*, the said axial projection (33) may form a tube portion (34) forming a duct clamping an upper part (41) of the said application means (4), so as to fix the said application means (4) to the said cap (3).

As illustrated in FIG. 7*b*, the said axial projection (33) may include a plurality of N axial projections (35), where N varies from 3 to 8, arranged around an upper part (41) of the said application means (4), so as to clamp the said upper part (41) and thus fix the said application means (4) to the said cap (3).

These projections may comprise a hook (350) at their ends.

As shown in FIG. 7*c*, the said axial projection (33) may comprise a central axial projection (36) penetrating into an upper part (41) of the said application means (4), the said central axial projection (36) typically comprising at least one hook (360) oriented as a harpoon, so as to prevent any axial displacement or subsequent withdrawal of the said application means (4) from the said cap (3).

Figure 7E:
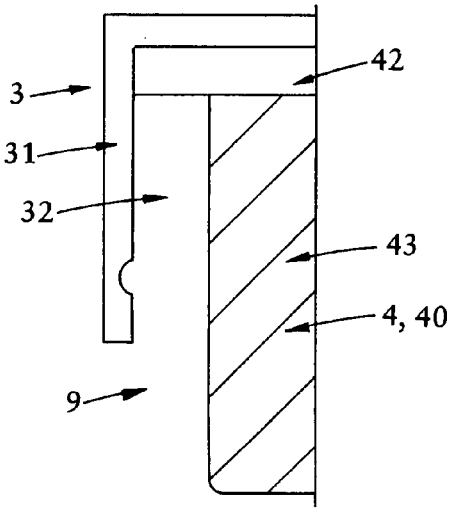
Figure 7F:
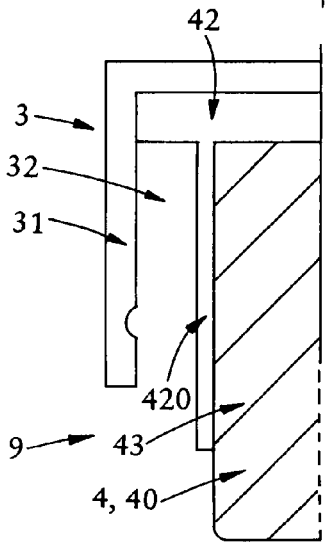

As illustrated in FIGS. 7*e* and 7*f*, the said application means (4) may include an application material (43) assembled onto a support (42), the said support (42) forming the upper part of the said application means (4) fixed to the said cap (3).

Typically, the said application means (4) or the said application block (40) or the said application material (43) may include or may be composed of a material in the divided or fibrous or honeycomb state, for example a honeycomb foam or a felt, capable of retaining a fraction of the said powder for subsequent application typically onto the face.

Figure 4F:
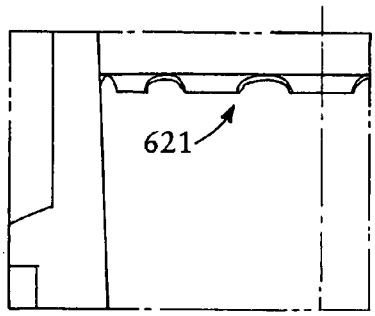
FIG. 4*f* is an enlarged fragment of FIG. 4*e*.
Figure 4C:
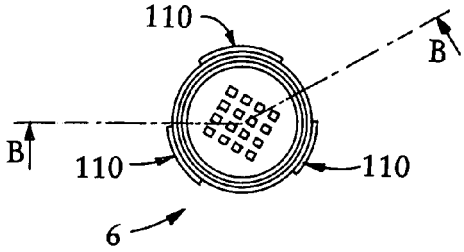
Figure 4A:
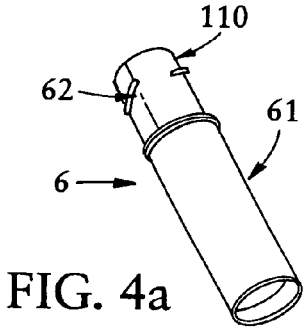
Figure 4B:
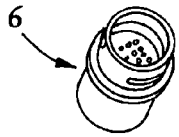
Figure 8A:
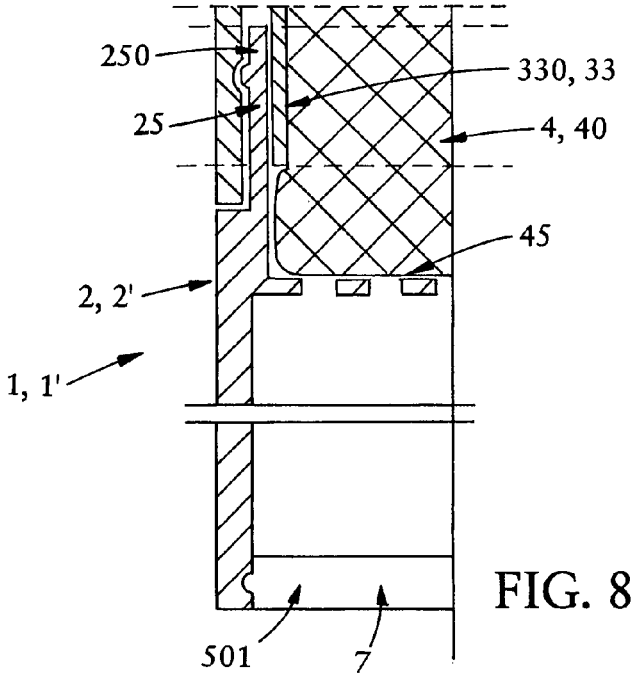
FIGS. 8*a* and 8*b* are partial axial sections of dispensers (1, 1') illustrating other embodiments of the receptacle (2).
Figure 8B:
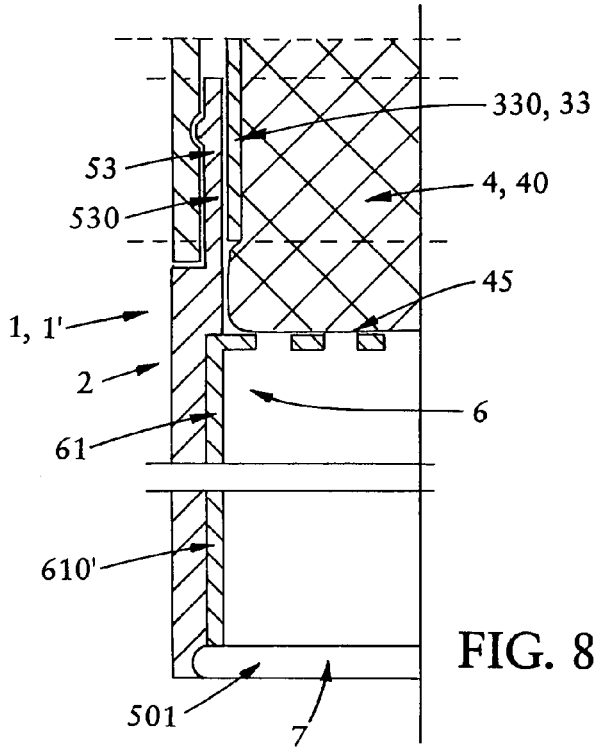

As illustrated particularly in FIGS. 4*a*, 4*e* and 4*d*, and in FIGS. 8*a* and 8*b*, the said receptacle (2) or the said outer body (5) or the said inner part (6) may include an upper skirt (25, 53, 62) forming an upper cavity (26) with the said dome (22) capable of housing a lower part (44) of the said application means (4), the said upper skirt (25, 53, 62) being capable of being housed in the said annular space (32) when the said applicator dispenser (1, 1') is closed.

The said upper skirt (25, 53, 62) may be coaxial with the said axial projection (33) along the said axial direction (10), typically with the said tube portion (34) or the said plurality of projections (35).

As illustrated particularly in FIGS. 8*a* and 8*b*, the said upper skirt (25, 53, 62) may be concentric with the said axial projection (33), typically with the said tube portion (34) or the said plurality of projections (35), the said upper skirt (25, 53, 62) including an upper portion (250, 530, 620) covering the outside of a lower portion (330) of the said axial projection (33) over an axial distance ΔH varying up to 0.8 $H_S$, where $H_S$ is the height of the said upper skirt (25, 53, 62).

Figure 1D:
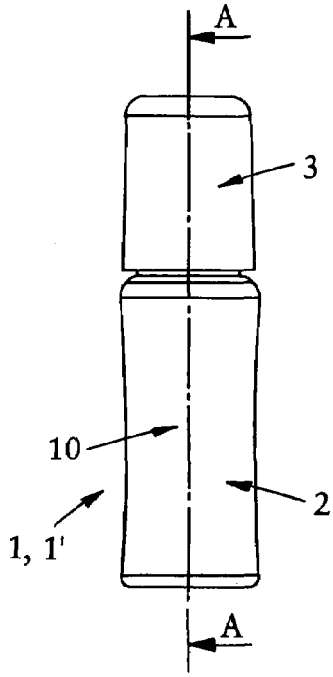
FIG. 1*d* shows a side view of the closed dispenser (1)
Figure 1C:
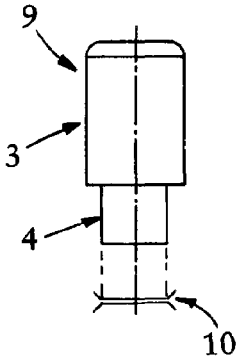
FIG. 1*c* shows a side view of the applicator (9)
Figure 1B:
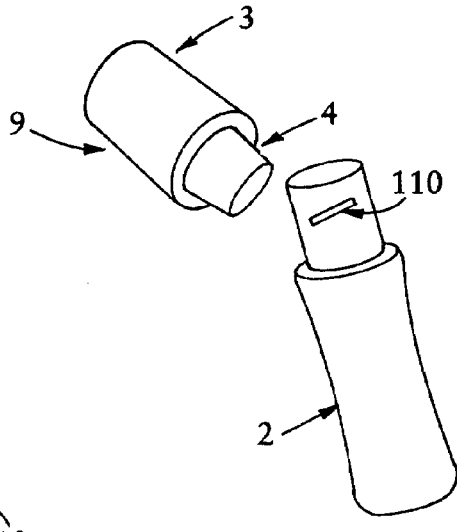
FIG. 1*b* shows a perspective view of the open dispenser (1), the applicator (9) formed by the cap (3) fixed to the application means (4) being separated from it by unscrewing the receptacle (2).
Figure 1A:
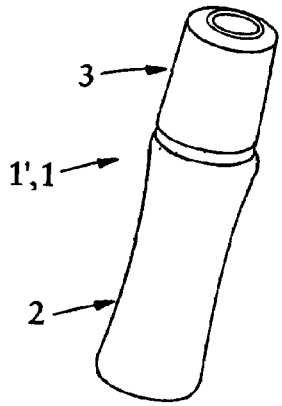
FIG. 1*a* shows a perspective view of the closed dispenser (1).

According to the invention and as illustrated in FIGS. 1*a*, 8*a* and 8*b*, the said side skirt (31) of the said cap (3) may cooperate with the said upper skirt (25, 53, 62) of the said receptacle (2) or the said outer body (5) or the said inner part (6) by screwing by means of a thread (11) when the said receptacle (2) is closed, the said thread comprising at least one total or partial helical groove (111) cooperating with at least one total or partial helical rib (110).

Advantageously, the said cap (3) is screwed to the said receptacle (2) by a so-called direct rotation of the said cap (3) and the said applicator dispenser (1, 1') thus being closed, the said cap (3) and the said receptacle (2) may cooperate so as to form a blocking means to prevent accidental inverse rotation of the said cap (3).

Figure 5A:
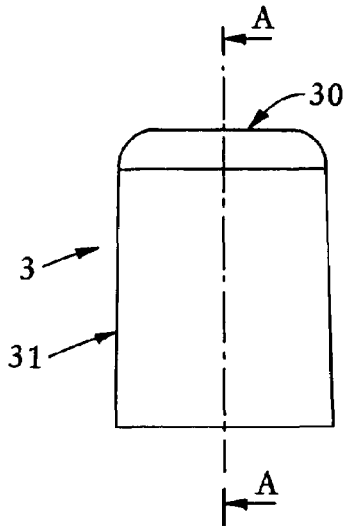
Figure 5C:
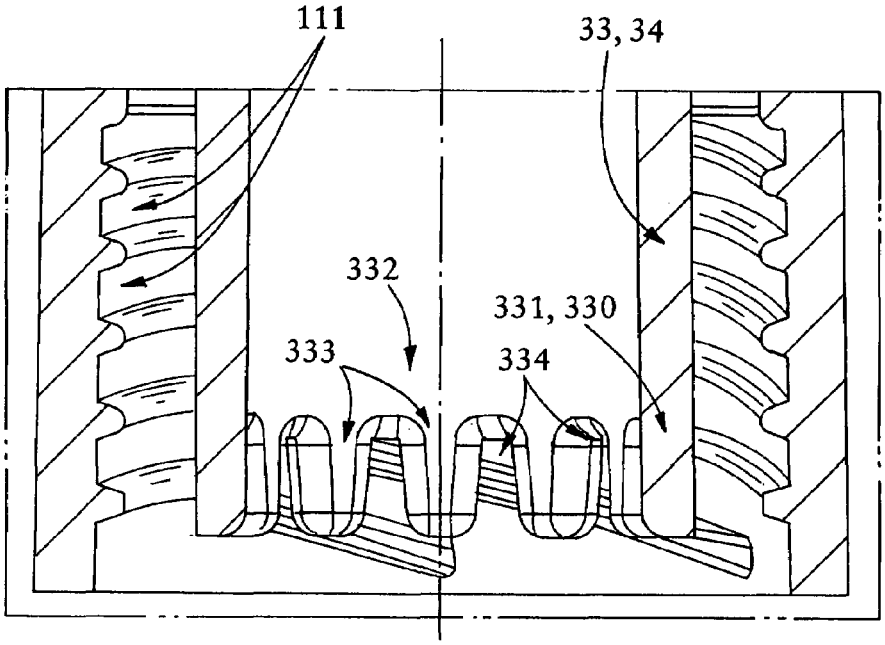

Thus, as can be seen in FIG. 2*c* and starting from FIGS. 4*f* and 5*c*, the said axial projection (33) of the said cap (3) may cooperate with the said upper skirt (25, 53, 62) of the said receptacle, or the said outer body (5) or the said inner part (6), so as to form the said blocking means, the said axial projection (33) of the said cap (3) being composed of the said tube portion (34) or the said plurality of N radial projections (35).

As shown in FIGS. 5*b* and 5*c*, the lower end (331) of the said axial projection (33) of the said cap (3) may typically include a castellated part (332), for example with a plurality of n portions of rods (333) at a uniform angular spacing separated by a plurality of n recesses (334), where n varies from 6 to 60, typically at its lower end (331), the said castellated part (332) forming a so-called inner bottom closer perpendicular to the said axial direction (10), and in which the inner surface of the said upper skirt (25, 53, 62) typically comprises a complementary castellated part (251, 531, 621), for example a castellated radial circular lip comprising a plurality of n radial recesses, typically on its inner surface, such that the said plurality of n portions of rods can temporarily cooperate with the said plurality of n radial recesses (252, 532, 622) and the said screwing requires a manual screwing torque $C_V$, typically at the end of screwing and varying periodically n times per turn, with a maximum value $C_{VM}$ each time that each of the n rod portions (333) are located between two consecutive recesses (252, 532, 622), the said maximum value $C_{VM}$ being chosen to be fairly high to prevent the said cap (3) from coming unscrewed by itself, typically due to torsion of the said application means (4) that could occur during the said screwing, and low enough to enable subsequent manual unscrewing of the said cap (3) without excessive force.

Typically, the said castellated part (332) of the said cap (3) and the said complementary castellated part (251, 531, 621) of the said upper skirt (25, 53, 62) may be chosen such that the said maximum value $C_{VM}$ remains constant during the said screwing, the said screwing being terminated when a part of the said cap (3) comes into axial stop with a part facing the said receptacle (2).

However, the said castellated part (332) of the said cap (3) and the said complementary castellated part (251, 531, 621) of the said upper skirt (25, 53, 62) may be chosen such that the said maximum value $C_{VM}$ increases progressively during the said screwing.

As illustrated in FIGS. 1*e*, 8*a* and 8*b*, the said application means (4) may have a lower surface (45) typically in contact with the said perforated upper dome (22), such that a fraction $S_O/S$ of the said lower surface area (45) facing the said orifice(s) (23, 24) is in contact with the said powder, the said fraction $S_O/S$ typically varying from 0.1 to 0.6, where $S_O$ is the area of the orifice(s) and S is the total area of the said lower surface (45).

Preferably, all or part of the said application means (4) may have an axial resilience or elasticity so that it is in a state of slight axial compression between the said head (30) and the said upper dome (22) when the said applicator dispenser (1, 1') is closed, the said slight axial compression corresponding to a reduction in the height of the said application means typically varying from 2% to 20%.

Thus, the orifice (23) or the plurality of orifices (24) are closed off when the said dispenser is closed, so that the said product remains confined in the said reservoir (27).

As illustrated in FIGS. 1*a* and 1*d*, the dispenser (1, 1') may have a symmetry of revolution.

In the dispenser embodiment shown in FIGS. 1*a* to 5*c*, the said side skirt (31) of the said cap comprises a plurality of helical grooves (111) on its inner surface, designed to cooperate with a plurality of helical ribs (110) on the outer surface of the said upper skirt (25, 53, 62) of the said receptacle (2) when the said dispenser (1, 1') is closed.

As illustrated in FIGS. 4*c* and 4*d*, the said plurality of ribs may comprise 3 ribs at 120° from each other and extending at an angle α varying from 40° to 120°, and preferably from 50° to 80°, so as to close/open the said dispenser by a low amplitude relative rotation.

As illustrated in FIGS. 9*a* and 9*b*, the said receptacle (2) may form a tube (29) comprising an upper skirt (290), a dome (293) provided with a plurality of orifices (291) and a lower skirt (292) designed to form the said reservoir (27) and including an opening (294) so as to be able to fill the said reservoir (27) through the said opening (294), and then closing it, forming a typically heat sealed lower edge (295). The tube (29) is typically a single-piece moulded part made of a thermoplastic material.

Figure 2A:
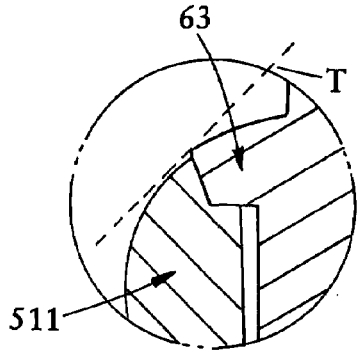
FIG. 2*a* shows an enlarged view of the part surrounded by a circle marked "a" in FIG. 1*e*.

As illustrated particularly in FIG. 2*a*, the said inner part (6) may comprise a radial shoulder (63) that stops in contact with the said outer wall (51) at its upper end (511), the said radial shoulder (63) and the said upper end (511) being connected along the same tangent T so as to have continuity of the outer surface.

According to the invention, the said reservoir (27) may have an inner capacity or volume typically varying from 2 to 10 $cm^3$ and preferably from 3 $cm^3$ to 5 $cm^3$. Although the invention is not limited to small "nomad" applicator dispensers, its prime application is applicator dispensers with a shape and size similar to the shape and size of lipstick tubes.

EXAMPLE EMBODIMENTS

The Applicator Dispenser (1, 1') was Made According to FIGS. 1*a* to 5*c*

Figure 3E:
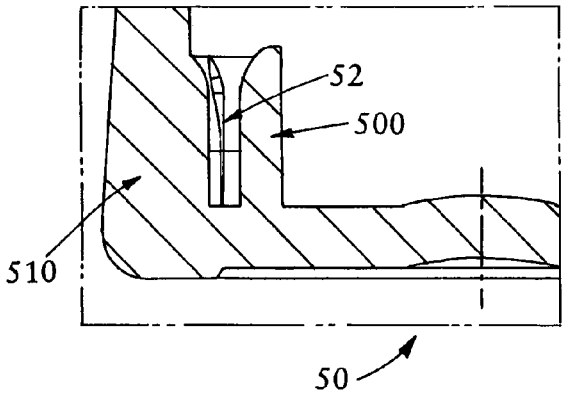
FIGS. 3*a* to 3*e* relate to the outer body (5) of the said receptacle (2).
Figure 3D:
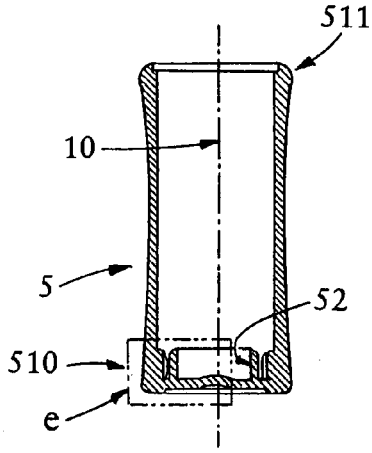
Figure 3C:
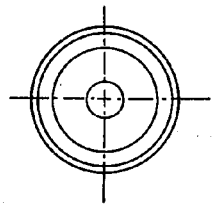
Figure 3B:
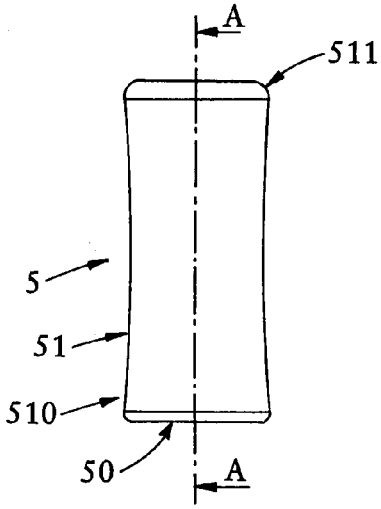
Figure 3A:
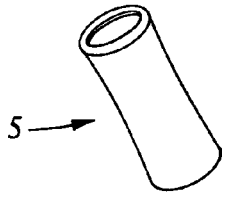

This was done firstly by procuring or manufacturing the component parts of the applicator dispenser (1, 1'), namely:

a) the outer body (5) corresponding to FIGS. 3*a* and 3*e* was formed by moulding a thermoplastic material, for example made of SAN or ABS/SAN.

Dimensions of this outer body (5) with a bent profile: height 41.5 mm, largest diameter 18.21 mm and smallest diameter 16.62 mm.

b) the inner part (6) corresponding to FIGS. 4*a* to 4*e* was formed by moulding a thermoplastic material, for example made of PP. It comprises a dome (60, 22) with 16 square orifices with side dimensions 0.8 mm and at a spacing of 0.8 mm, a shoulder (63), a set of three helical ribs (110) and a castellated inner dome (621).

Dimensions of the inner part (6):

total height 55.7 mm with a 38.4 mm part below the shoulder (63), and a 16.46 mm part above the shoulder (63).

inside diameter varying from 10.7 mm for the part above the dome (60) to 11.65 mm for the lower part of the inner wall (61).

outside diameter 17.8 mm for the part above the shoulder (63).

c) the cap (3) corresponding to FIGS. 5*a* to 5*c* was formed by moulding a plastic material, for example PP, or SAN or ABS or ABS/SAN. The cap comprises an axial projection (33) forming a tube portion (34), slightly shorter by 1.2 mm than the side skirt (31).

Cap Dimensions:

height 24 mm outside diameter of the side skirt (31) 17 mm and inside diameter 13.15 mm outside diameter of the axial projection (33) 10.5 mm.

d) 30 mm high blocks of application material (4, 40) were cut out with a diameter approximately equal to the inside diameter of the said tube portion (34), from an NBR synthetic foam.

The next step was to force fit the block of application material (40) into the said tube portion (34) so as to form the applicator (9), that is assembled by screwing to the inner part (6).

After the assembly (9+6) obtained above has been filled through the bottom, the outer body (5) is clicked fitted.

Other Applicator Dispenser (1, 1') Embodiments were also Made

Similarly, an applicator dispenser (1, 1') was made according to FIGS. 6*a* and 6*b*.

In this case, the said inner part (6) comprises a short skirt (610") that will cooperate with the end (511) of the outer wall (51) by a click fit type assembly (28) of male and female parts.

Figure 6C:
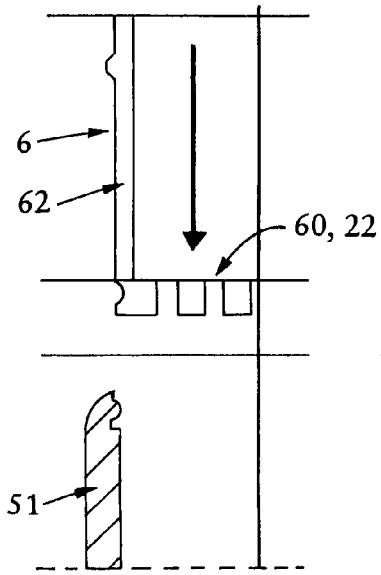
FIGS. 6*c* and 6*d*, which correspond to FIGS. 6*a* and 6*b* respectively, represent a variant of the receptacle (2) in FIGS. 6*a* and 6*b*.
Figure 6D:
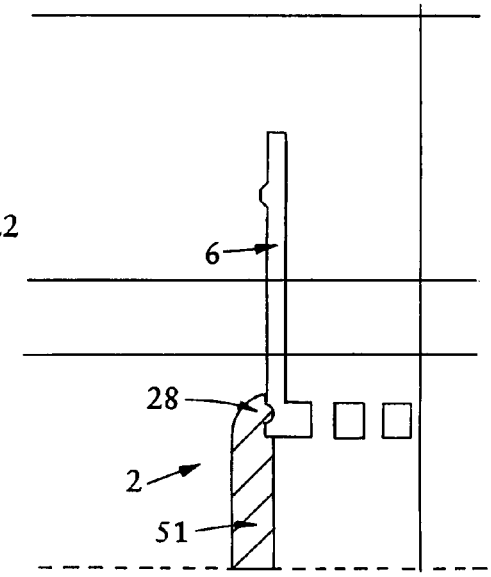

An applicator dispenser (1, 1') was also made in a similar manner according to FIGS. 6*c* and 6*d*. In this case, the inner part (6) is fixed to the outer wall (51) by click fitting at the perforated dome, the inner part (6) not having a skirt below the said perforated dome (60).

The applicators (9) were made according to FIGS. 7*a* to 7*f*. In all cases, a synthetic foam was used as the application material.

the applicator (9) in FIG. 7*a* is a "T" shaped foam block, the upper part of which is assembled typically by gluing to the cap (3), the applicator (9) in FIG. 7*b* comprises 6 radial projections (35) at a spacing of 60°, the end of which comprises a hook (350) that can bite into the block (40), the applicator (9) in FIG. 7*c* comprises a central projection (36) provided with a hook (360), the applicator (9) in FIG. 7*d* corresponds to the applicator in FIGS. 1*a* to 1*e*, the applicator (9) in FIG. 7*e* comprises a plastic insert (42) used to support the said block (40), the said block (40) typically being glued to the insert (42), the insert (42) in the applicator (9) in FIG. 7*f* includes a tubular axial projection (420).

Similarly, the dispenser in FIG. 8*a* was also made in which the said outer body (5) and the said inner part (6) only form a single part, a lower closer (7) then being necessary to close off the receptacle (2') that is necessarily filled through the bottom.

Similarly, the dispenser in FIG. 8*b* was also made in which the said outer body (5) comprises an upper skirt (53), whereas the inner part (6) only includes the said dome (60, 22) and an inner wall (61) forming a long skirt (610').

ADVANTAGES OF THE INVENTION

Firstly, the dispensers (1, 1') according to the invention are very practical to use, since they are used to apply a makeup powder without any risk of getting dirty.

Thus, these dispensers (1, 1') may form an alternative to compacts that contain a power in agglomerated form.

Furthermore, these dispensers may be leak tight, so as to enable packaging of powders that may contain a constituent that could evaporate.

Finally, these dispensers (1, 1') renew the packaging of powder cosmetic products with a shape and volume similar to the volume and shape of lipstick tubes, which is advantageous for building product ranges with a high aesthetic quality.

| List of marks | |
|---|---|
| Applicator dispenser | 1 |
| Longitudinal applicator dispenser | 1' |
| Axial direction | 10 |
| Helical screwing thread for 3 | 11 |
| Rib of 11 | 110 |
| Groove of 11 | 111 |
| Receptacle | 2, 2' |
| Sidewall | 20 |
| Bottom | 21 |
| Lower orifice | 210 |
| Upper dome | 22 |
| Orifice in 22 | 23 |
| Plurality of orifices | 24 |
| Upper skirt | 25 |
| Upper portion | 250 |
| Complementary castellated part | 251 |
| Radial recess | 252 |
| Upper cavity | 26 |
| Reservoir | 27 |
| Cooperation means (click fit) for 5 and 6 | 28 |
| Receptacle in tube form | 29 |
| Upper skirt | 290 |
| Plurality of orifices | 291 |
| Lower skirt | 292 |
| Dome | 293 |
| Opening of 292 | 294 |
| Heat sealed lower edge | 295 |

-continued

| List of marks | |
|---|---|
| Cap or cover | 3 |
| Head | 30 |
| Side skirt | 31 |
| Annular space between 4 and 31 | 32 |
| Axial projection | 33 |
| Lower portion | 330 |
| Lower end of 330 | 331 |
| Castellated part | 332 |
| Rod portion | 333 |
| Recesses between rods 331 | 334 |
| Tube portion | 34 |
| Plurality of N axial projections | 35 |
| Hooks | 350 |
| Central projection | 36 |
| Attachment hooks | 360 |
| Application means | 4 |
| Longitudinal block | 40 |
| Upper part of 4, 40 | 41 |
| Support | 42 |
| Application material | 43 |
| Lower part of 4, 40 | 44 |
| Lower surface of 40 or 43 | 45 |
| Sidewall of 40 or 43 | 46 |
| Outer body of 2 | 5 |
| Bottom of 5 | 50 |
| Inner bottom closer | 500 |
| Lower orifice | 501 |
| Outer wall | 51 |
| Lower end | 510 |
| Upper end | 511 |
| Annular cavity between 500 and 51 | 52 |
| Upper skirt | 53 |
| Upper portion | 530 |
| Complementary castellated part | 531 |
| Radial recess | 532 |
| Inner part of 2 | 6 |
| Dome = 22 | 60 |
| Inner wall | 61 |
| Lower part of 61 | 610 |
| Long skirt | 610' |
| Short skirt | 610" |
| Lower end of 61 | 611 |
| Upper skirt | 62 |
| Upper portion | 620 |
| Complementary castellated part | 621 |
| Radial recess | 622 |
| Radial shoulder | 63 |
| Lower closer | 7 |
| Insert for 3 | 8 |
| "Cap (3) + application means (4) "applicator | 9 |

The invention claimed is:

1. An applicator dispenser (1) of a powder product, typically a cosmetic product forming a powder, comprises a) a receptacle (2) forming a reservoir (27) that will contain said powder product, said receptacle (2) comprising a sidewall (20), an upper dome (22) with perforations something like a netting with at least one orifice (23) or a plurality of orifices (24) through which said powder can pass so that it can be used, and typically a bottom (21), b) a cap or cover (3) comprising a head (30) and a side skirt (31) cooperating with said receptacle (2) when said applicator dispenser (1) is closed so as to close said receptacle (2), and c) an application means (4) for said powder housed between said head (30) and said dome (22), characterized in that:

1) said application means (4) is fixed to said cap (3) due to an attachment means to form an applicator (9), such that said cap (3) acts like a manual means of gripping said application means (4) without any risk of getting the fingers dirty, 2) the applicator dispenser has an H/D shape factor equal to at least 1.5, so that the applicator dispenser (1, 1') is longitudinal and has an axial direction (10), where H is the height of said applicator dispenser (1') along said axial direction (10), and D denotes its maximum transverse dimension or its diameter in the case of an applicator dispenser (I') with a constant circular cross section over all of said height H, 3) said cap (3) being screwed to said receptacle (2) by a direct rotation of said cap (3) and said applicator dispenser (1, 1') thus being closed, said cap (3) and said receptacle (2) cooperate so as to form a blocking means to prevent accidental inverse rotation of said cap (3).

2. The applicator dispenser according to claim 1, with said H/D shape factor being equal to at least 2, and preferably equal to at least 3.

3. The applicator dispenser according to claim 1, in which said receptacle (2) comprises an outer body (5) comprising a bottom (50) and an outer wall (51), and an inner part (6) comprising said dome (22, 60) and an inner wall (61) fixing said inner part (6) to said outer body (5), typically by axial click fitting.

4. The applicator dispenser according to claim 1, in which said inner wall (61) of said inner part (6) comprises a lower part (610) forming a lower skirt fixing said inner part (6) to said outer body (5), typically by axial click fitting.

5. The applicator dispenser according to claim 4, in which said lower skirt is a long skirt (610').

6. The applicator dispenser according to claim 5, in which said long skirt (610') cooperates at its lower end (611) with an inner bottom closer (500) fixed to said bottom (50), such that said lower end (611) is force fitted into an annular cavity (52) formed between said inner bottom closer (500) and said outer wall (51) at its lower end (510).

7. The applicator dispenser according to claim 5, in which said lower skirt is a short skirt (610") with a sufficient axial height to achieve said axial click fitting.

8. The applicator dispenser according to claim 1, in which said bottom (21) of said receptacle (2) or said bottom (50) of said outer body (5) comprises or forms a lower orifice (210) closed off by a lower closer (7), said lower closer (7) being fixed to said receptacle (2) or to said outer body (5), typically by axial click fitting, after said applicator dispenser (1, 1') has been filled through the bottom.

9. The applicator dispenser according to claim 1, in which said application means (4) is fixed to the head (30) of said cap (3) to form said applicator (9), and in which said application means (4) has a section in a transverse plane chosen so as to have an annular space (32) between said side skirt (31) of said cap (3) and said application means (4).

10. The applicator dispenser according to claim 1, in which said application means (4) forms a longitudinal application block (40) with height $H_A$ varying from 10 mm to 60 mm, and preferably from 20 mm to 50 mm.

11. The applicator dispenser according to claim 1, in which said cap (3) includes an axial projection (33) fixed at its upper end to said head (30) of said cap (3) or an insert (8) assembled to said cap (3), said axial projection (33) forming said attachment means.

12. The applicator dispenser according to claim 11, in which said axial projection (33) forms a tube portion (34) forming a duct clamping an upper part (41) of said application means (4), 50 as to fix said application means (4) to said cap (3).

13. The applicator dispenser according to claim 11, in which said axial projection (33) include a plurality of N axial projections (35), where N varies from 3 to 8, arranged around an upper part (41) of said application means (4), so as to clamp said upper part (41) and thus fix said application means (4) to said cap (3).

14. The applicator dispenser according to claim 11, in which said axial projection (33) comprises a central axial projection (36) penetrating into an upper part (41) of said application means (4), said central axial projection (36) typically comprising at least one hook (360) oriented like a harpoon, so as to prevent any axial displacement or subsequent withdrawal of said application means (4) from said cap (3).

15. The applicator dispenser according to claim 1, in which said application means (4) comprises an application material (43) assembled onto a support (42), said support (42) forming the upper part of said application means (4) fixed to said cap (3).

16. The applicator dispenser according to claim 1, in which said application means (4) or said application block (40) or said application material (43) includes or is composed of a material in the divided or fibrous or honeycomb state, for example a honeycomb foam or a felt, capable of retaining a fraction of said powder for subsequent application typically onto the face.

17. The applicator dispenser according to claim 9, in which said receptacle (2), or said outer body (5), or said inner part (6) includes an upper skirt (25, 53, 62) forming an upper cavity (26) with said dome (22) capable of housing a lower part (44) of said application means (4), said upper skirt (25, 53, 62) being capable of being housed in said annular space (32) when said applicator dispenser (1, 1') is closed.

18. The applicator dispenser according to claim 17, in which said upper skirt (25, 53, 62) is coaxial with said axial projection (33) along said axial direction (10), typically with said tube portion (34) or said plurality of projections (35).

19. The applicator dispenser according to claim 18, in which said upper skirt (25, 53, 62) is concentric with said axial projection (33), typically with said tube portion (34) or said plurality of projections (35), said upper skirt (25, 53, 62) including an upper portion (250, 530, 620) covering the outside of a lower portion (330) of said axial projection (33) over an axial distance ΔH varying up to 0.8 Hs, where Hs is the height of said upper skirt (25, 53, 62).

20. The applicator dispenser according to any one of claims 1 to 19 claim 1, in which said side skirt (31) of said cap (3) cooperates with said upper skirt (25, 53, 62) of said receptacle (2), or said outer body (5), or said inner part (6), by screwing using a thread (11) when said receptacle (2) is closed, said thread including at least one total or partial helical groove (111) cooperating with at least one total or partial helical rib (110).

21. The applicator dispenser according to claim 1, in which said axial projection (33) of said cap (3) cooperates with said upper skirt (25, 53, 62) of said receptacle, or said outer body (5), or said inner part (6) so as to form said blocking means, said axial projection (33) of said cap (3) being composed of said tube portion (34) projections (35).

22. The applicator dispenser according to claim 21, in which of said cap said axial projection (33) of said cap (3) includes a castellated part (332), for example with a plurality of n portions of rods (333) at a uniform angular spacing separated by a plurality of n recesses (334), where n varies from 6 to 60, typically at its lower end (331), said castellated part (332) forming a so-called inner bottom closer perpendicular to said axial direction (10), and in which the inner surface of said upper skirt (25, 53, 62) typically comprises a complementary castellated part (251, 531, 621), for example a castellated radial circular lip comprising a plurality of n radial recesses, typically on its inner surface, such that said plurality of n portions of rods can temporarily, cooperate with said plurality of n radial recesses (252, 532, 622) and said screwing requires a manual screwing torque $C_V$, typically at the end of screwing and varying periodically n times per turn, with a maximum value $C_{VM}$ each time that each of the n rod portions (333) are located between two consecutive recesses (252, 532, 622), said maximum value $C_{VM}$ being chosen to be fairly high to prevent said cap (3) from coming unscrewed by itself, typically due to torsion of said application means (4) that could occur during said screwing, and low enough to enable subsequent manual unscrewing of said cap (3) without excessive force.

23. The applicator dispenser according to claim 22 in which said castellated part (332) of said cap (3) and said complementary castellated part (251, 531, 621) of said upper skirt (25, 53, 62) are chosen such that said maximum value $C_{VM}$ remains constant during said screwing, said screwing being terminated when a part of said cap (3) comes into axial stop with a part facing said receptacle (2).

24. The applicator dispenser according to claim 22, in which said castellated part (332) of said cap (3) and said complementary castellated part (251, 531, 621) of said upper skirt (25, 53, 62) are chosen such that said maximum value $C_{VM}$ increases progressively during said screwing.

25. The applicator dispenser according to claim 1, in which said application means (4) has a lower surface (45) typically in contact with said perforated upper dome (22), such that a fraction $S_O/S$ of said lower surface area (45) facing said orifice(s) (23, 24) is in contact with said powder, said fraction $S_O/S$ typically varying from 0.1 to 0.6, where $S_O$ is the area of the at least one orifice and S is the total area of said lower surface (45).

26. The applicator dispenser according to claim 25, in which said application means (4) has an axial resilience or elasticity so that it is in a state of slight axial compression between said head (30) and said upper dome (22) when said applicator dispenser (1, 1') is closed, said slight axial compression corresponding to a reduction in the height of said application means typically varying from 2% to 20%.

27. The applicator dispenser according to claim 1 having a symmetry of revolution.

28. The applicator dispenser according to claim 20, in which said side skirt (31) of said cap comprises a plurality of helical grooves (111) on its inner surface, designed to cooperate with a plurality of helical ribs (110) on the outer surface of said upper skirt (25, 53, 62) of said receptacle (2) when said dispenser (1, 1') is closed.

29. The applicator dispenser according to claim 28, in which said plurality of ribs comprise three ribs at 120° from each other and extending at an angle a varying from 40° to 120°, and preferably from 50° to 80°, so as to close/open said dispenser by a low amplitude relative rotation.

30. The applicator dispenser according to claim 1, in which said receptacle (2) forms a tube (29) comprising an upper skirt (290), a dome (293) provided with a plurality of orifices (291) and a lower skirt (292) designed to form said reservoir (27) and including an opening (294) so as to be able to fill said reservoir (27) through said opening (294), and then closing it, forming a typically heat sealed lower edge (295).

31. The applicator dispenser according to claim 3, in which said inner part (6) comprises a radial shoulder (63) that stops in contact with said outer wall (51) at its upper end (511), said radial shoulder (63) and said upper end (511) being connected along the same tangent T so as to have continuity of the outer surface.

32. The applicator dispenser according to claim 1, in which said reservoir (27) has an inner capacity or volume typically varying from 2 to 10 cm3 and preferably from 3 $cm^3$ to 5 $cm^3$.

* * * * *